US011001464B2

(12) United States Patent
Yan et al.

(10) Patent No.: US 11,001,464 B2
(45) Date of Patent: May 11, 2021

(54) GRIPPER BAR LOCKING APPARATUS AND SHEET PROCESSING DEVICE

(71) Applicant: BOBST (Shanghai) LTD, Shanghai (CN)

(72) Inventors: Xiao Yan, Shanghai (CN); Ludovic Gortais, Shanghai (CN)

(73) Assignee: BOBST (SHANGHAI) LTD, Shanghai (CN)

( * ) Notice: Subject to any disclaimer, the term of this patent is extended or adjusted under 35 U.S.C. 154(b) by 191 days.

(21) Appl. No.: 16/469,026

(22) PCT Filed: Dec. 19, 2017

(86) PCT No.: PCT/IB2017/058126
§ 371 (c)(1),
(2) Date: Jun. 12, 2019

(87) PCT Pub. No.: WO2018/116157
PCT Pub. Date: Jun. 28, 2018

(65) Prior Publication Data

US 2019/0367305 A1 Dec. 5, 2019

(30) Foreign Application Priority Data

Dec. 20, 2016 (CN) ..... 201611186507.6

(51) Int. Cl.
*B65H 5/14* (2006.01)
*B26D 7/01* (2006.01)
(Continued)

(52) U.S. Cl.
CPC ..... *B65H 5/14* (2013.01); *B26D 7/015* (2013.01); *B41F 1/28* (2013.01); *B65H 5/085* (2013.01);
(Continued)

(58) Field of Classification Search
CPC ..... B65H 5/14; B65H 5/085; B65H 2402/64; B65H 2801/42; B65H 29/045;
(Continued)

(56) References Cited

U.S. PATENT DOCUMENTS 2,776,136 A 1/1957 Dietrich
3,822,644 A * 7/1974 Gazzola ..... B41F 21/05 101/242
(Continued)

FOREIGN PATENT DOCUMENTS

CN 2871386 Y 2/2007
CN 201390549 Y 1/2010
(Continued)

OTHER PUBLICATIONS

International Search Report issued in related PCT/IB2017/058126, dated Mar. 27, 2018 (2 pages).

*Primary Examiner* — Jeremy R Severson
(74) *Attorney, Agent, or Firm* — Bookoff McAndrews, PLLC

(57) ABSTRACT

The present invention discloses gripper bar locking apparatus and sheet processing device. In particular, the present invention discloses a gripper bar locking apparatus, which is configured to lock and adjust a position of a gripper bar, comprising: a supporting plate having a distal end and a proximal end; a lever portion, a distal end of which is pivotally mounted on the proximal end of the supporting plate; a cartridge movably mounted on a proximal end of the lever portion and provided with a gripper bar abutment; and an adjusting means provided on the cartridge and configured to adjust a position of the cartridge with respect to the lever portion. Further, the present invention relates to the sheet processing device including the gripper bar. By using the
(Continued)

gripper bar locking apparatus, the adjustment of the position of the gripper bar is facilitated.

10 Claims, 3 Drawing Sheets

(51) Int. Cl.
*B65H 5/08* (2006.01)
*B65H 29/04* (2006.01)
*B41F 1/28* (2006.01)

(52) U.S. Cl.
CPC ..... *B65H 29/044* (2013.01); *B65H 2402/64* (2013.01); *B65H 2403/53* (2013.01); *B65H 2404/342* (2013.01); *B65H 2601/326* (2013.01); *B65H 2801/42* (2013.01)

(58) Field of Classification Search
CPC ..... B65H 29/047; B65H 29/048; B65H 2301/4471; B65H 2301/44712; B65H 2404/34; B62D 7/015; B41F 21/04; B41F 21/05; B41F 21/08; B41F 21/10; B41F 21/104; B41F 21/106; B41F 1/28; B41F 1/30; B41F 1/36
See application file for complete search history.

(56) References Cited

U.S. PATENT DOCUMENTS 4,592,279 A * 6/1986 Kemmerer ..... B65H 5/14 101/412
4,781,370 A * 11/1988 Weisgerber ..... B65H 5/14 271/277
4,864,929 A * 9/1989 Simeth ..... B41F 21/104 101/246
5,758,576 A 6/1998 Mack et al.

FOREIGN PATENT DOCUMENTS

CN 201792558 U 4/2011
CN 202704671 U 1/2013

* cited by examiner

GRIPPER BAR LOCKING APPARATUS AND SHEET PROCESSING DEVICE

CROSS-REFERENCE TO RELATED APPLICATION(S)

This application is a National Stage under 35 U.S.C. § 371 of International Application No. PCT/IB2017/058126, filed on Dec. 19, 2017, which claims priority to Chinese Patent Application No. 201611186507.6, filed Dec. 20, 2016, the contents of all of which are incorporated by reference in their entirety.

TECHNICAL FIELD

The present invention relates to a sheet processing device, and in particular to a gripper bar locking apparatus applied to a sheet processing device.

BACKGROUND

Well-known sheet processing devices are applied to process sheet materials such as paper sheets or paper boards and so on.

One common sheet processing device is a hot foil stamping device which includes a plurality of stations including a platen die cutting station 100, as shown in FIG. 1. In the platen die cutting station 100, a pressing plate is disposed to move reciprocally relative to a fixed and flat bed to realize die cutting of a processed sheet disposed between the pressing plate and the bed. Such a platen die cutting station usually conveys processed sheets through an automatic conveyor system which can place the processed sheets between the pressing plate and the bed one by one.

In practice, the automatic conveyor system includes a plurality of gripper bars 90 which are formed by fixing a series of jaw on a beam. The front end of the jaw of the gripper bar 90 may clamp a processed sheet to pull the sheet to different stations. An end of the gripper bar 90 is connected to a chain forming a circulation path, and during the circulation of the chain, all gripper bars 90 fixed to the chain move to various stations along with the chain along the circulation path defined by the chain.

The gripper bar 90 first receives a sheet to be processed in a paper-feeding station. In order to ensure precise positioning of the sheet during processing in subsequent stations and avoid misalignment, it requires to initially ensure the precise positioning of the gripper bar 90 at a paper-feeding side. In order to realize this object, a gripper bar locking apparatus is provided at the paper-feeding side of the platen die cutter and a gripper bar position adjusting means is provided on the gripper bar locking apparatus. After a gripper bar moves to the paper-feeding side along with the chain and is locked by the gripper bar locking apparatus, the gripper bar position adjusting means finely adjusts the position of the gripper bar in a paper-feeding direction.

FIG. 2 shows a gripper bar locking apparatus 200 applied in an existing sheet processing device. The gripper bar locking apparatus 200 includes a supporting plate 210 and a locking portion 220 pivotally connected to the supporting plate 210.

One end of the locking portion 220 is connected to the supporting plate 210 through a pivot portion and the other end is connected to a connecting lever 250 through a pivot portion. The connecting lever 250 is in turn connected to an actuating means (not shown). By means of the drive of the actuating means, the locking portion 220 moves between a locked position and an unlocked position around the pivot portion. In the locked position, a locking roller provided in the locking portion 220 is abutted against a positioning portion of the gripper bar to lock the gripper bar. The supporting plate 210 is movably assembled to a frame 110 of the device, and an adjusting member 280 is provided at a distal end of the supporting plate 210 opposite to the pivot portion for adjusting the position of the supporting plate 210 relative to the frame 110.

The adjusting member 110 is in particular an adjusting bolt. By screwing the adjusting bolt, the supporting plate 210 drives the locking portion to move back and forth along a paper advance direction indicated by arrow A to adjust the precise position of the gripper bar.

During the operation of the sheet processing device, especially before the start of each processing, the adjusting member 110 has to be adjusted manually to ensure the precise position of the gripper bar at the paper-feeding side so that processing precision of product printing, lamination and so on during subsequent procedures can be ensured.

However, in the sheet processing device, actually, components such as protection cover, chain wheel at the gripper bar end, connecting lever and so on, as shown by the dashed line in FIG. 2, are disposed at the periphery of the distal end of the supporting plate 210 where the adjusting member 110 is installed and thus it is not easy for an operator to adjust the adjusting member 210 and it is difficult to finely adjust the gripper bar locking apparatus 200. Therefore, the gripper bar locking apparatus still needs to be improved.

SUMMARY

In order to overcome the above deficiencies, the present invention provides with a gripper bar locking apparatus, which is configured to lock and adjust a position of a gripper bar, comprising: a supporting plate having a distal end and a proximal end; a lever portion, a distal end of which is pivotally mounted on the proximal end of the supporting plate; a cartridge movably mounted on a proximal end of the lever portion and provided with a gripper bar abutment; and an adjusting means provided on the cartridge and configured to adjust a position of the cartridge with respect to the lever portion.

According to an aspect of the present invention, lever portion comprises a sliding portion, and the cartridge slides on the sliding portion, and the cartridge is further provided with a fastening means for locking the cartridge with respect to the sliding portion of the lever portion.

According to another aspect of the present invention, the gripper bar abutment is a roller pivotally mounted on the cartridge, and the roller is located below a bottom of the lever portion.

According to another aspect of the present invention, the adjusting means is an adjusting bolt extending through a hole providing in the cartridge into a threaded hole provided at a side surface at the proximal end of the supporting plate.

According to another aspect of the present invention, the lever portion is configured to move between an engagement position, where the gripper bar abutment engages with the gripper bar, and a disengagement position, where the gripper bar abutment disengages from the gripper bar to release the locking.

According to another aspect of the present invention, the gripper bar further comprises a connecting lever, a proximal end of the connecting lever is pivotally connected to the lever portion, and the connecting lever is configured to connect to an actuating means, by an action of the actuating means, the connecting lever moves the lever portion between the engagement position and the disengagement position.

According to another aspect of the present invention, the lever portion includes a first extension and a second extension, the first extension is pivotally connected to the supporting plate, the second extension is pivotally connected to the connecting lever, and a recess is formed between the first extension and the second extension, the proximal end of the supporting plate is received in the recess.

Further, the present invention provides with a sheet processing device, comprising: a plurality of sheet processing stations; a conveyor including a plurality of gripper bars for gripping a sheet, which is moved to the plurality of stations with a movement of conveyor; and the gripper bar locking apparatus as above mentioned and positioned on at least one of the plurality of sheet processing stations so as to lock one of the gripper bars at the at least one station, and the supporting plate of the gripper bar locking apparatus is fixed to a frame of the sheet processing device.

According to another aspect of the present invention, the plurality of sheet processing stations comprises a platen die cutting station (100), and the gripper bar locking apparatus is mounted at a sheet-feeding side of the platen die cutting station.

According to another aspect of the present invention, an end of the gripper bar is provided with a locating block, which is arranged to abut against the gripper bar abutment.

The positions of a cartridge and an adjusting means of a gripper bar locking apparatus according to the present invention are toward the paper-feeding direction and can be accessed by an operator easily, and thus it is convenient to adjust a gripper bar along the paper advance direction.

In addition, a supporting plate is a fixed and stationary component and thus the overall rigidity of the gripper bar locking apparatus is improved. Meanwhile, a lever portion is connected to a connecting lever through a second extension, and thus the lever portion is connected across the supporting plate and the connecting lever so that the rigidity of the lever portion per se is ensured and the locking precision of the gripper bar locking apparatus is improved correspondingly.

DETAILED DESCRIPTION

Hereinafter, the present invention will be described further in conjunction with particular embodiments and accompanying drawings. More details are illustrated in the following description for sufficient understanding of the present invention, however, the present invention can be implemented in many other manners different from what is described here obviously. A person skilled in the art can make similar promotions and deductions without departing from the essence of the present invention as required and thus the protection scope of the present invention shall not be limited by the disclosure of these particular embodiments.

It should be noted that the "proximal end" and "distal end" in the text are used to distinguish ends of various components, "distal end" usually refers to an end away from the operator and "proximal end" usually refers to an end close to the operator.

Figure 1:
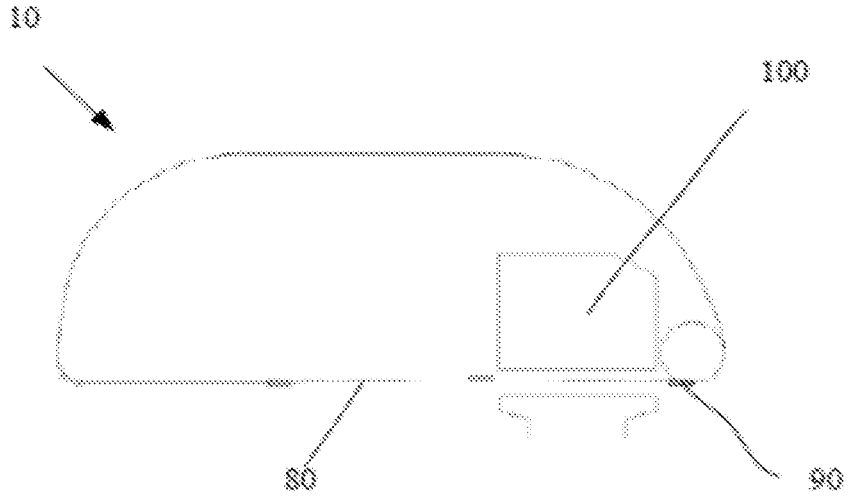
PRIOR ART Fig. 1
FIG. 1 is a schematic diagram of a sheet processing device suitable for being equipped with a gripper bar locking apparatus.
Figure 2:
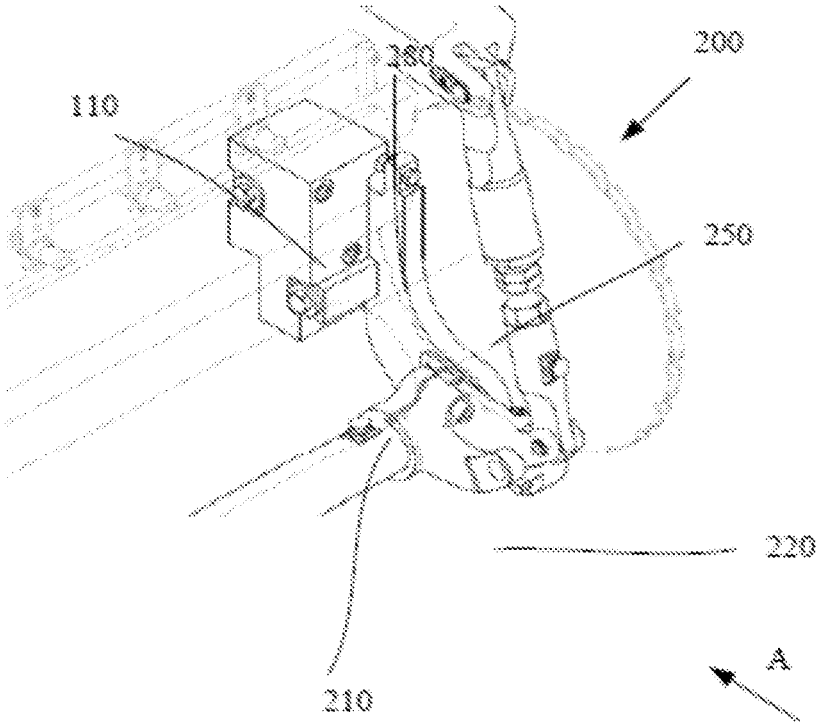
PRIOR ART Fig. 2
FIG. 2 shows an existing gripper bar locking apparatus.

FIG. 1 schematically shows a sheet processing device 10 suitable for combining with a gripper bar locking apparatus according to the present invention. The sheet processing device 10 includes a plurality of processing stations including for example a platen die cutting station 100 which obtains a sheet such as a paper board from an upstream paper-feeding station (not shown). Traditionally, at the paper-feeding station, paper boards expand through a clamping member layer by layer, a previous paper board partially covers a subsequent paper board, and a conveyor belt is adopted to feed the paper boards to a die cutting station.

The sheet processing device 10 delivers paper sheets through a conveyor apparatus 80. Starting from the platen die cutting station, the conveyor apparatus 80 conveys paper boards to move along various processing stations to carry out a series of processing operations. In particular, the conveyor apparatus 80 includes a plurality of gripper bars 90. Each gripper bar 90 has a plurality of spaced-apart jaws 92 on a gripper bar rod. An end of the rod is provided with a chain wheel connected to a chain. Under the drive of the chain, the paper sheets clamped by the jaws 92 move forward along the circulation path of the plurality of processing stations.

Figure 3:
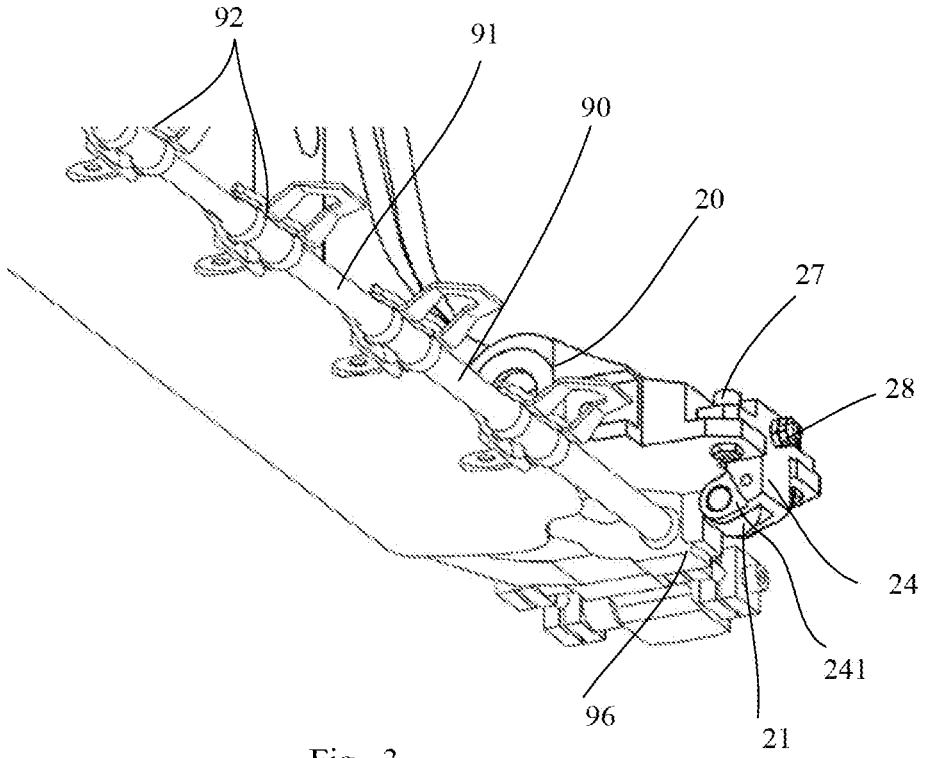
FIG. 3 shows a bottom perspective view of a gripper bar locking apparatus according to a preferred embodiment of the present invention.
Figure 4:
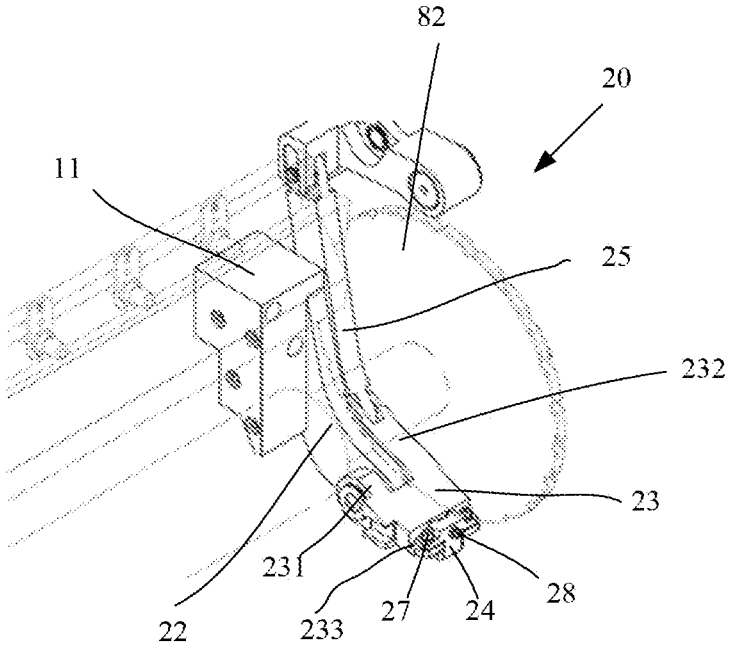
FIG. 4 shows a bottom perspective view of a gripper bar locking apparatus according to a preferred embodiment of the present invention.

As shown in FIGS. 3 and 4, in order to precisely position the paper sheet at each processing station, a gripper bar locking apparatus 20 is provided at the paper-feeding side of the platen die cutting station 100. The gripper bar locking apparatus 20 locks the position of one gripper bar at the paper-feeding side. In the case where the position of the gripper bar 90 is locked, the jaws 92 clamp the sheet conveyed from the paper-feeding station along the paper advance direction, and the initial position of the gripper bar 90 is locked precisely by adjusting the position of the entire gripper bar 90 along the paper advance direction.

According to a preferred embodiment of the present invention, as shown in FIG. 4, the gripper bar locking apparatus 20 includes a supporting plate 22, a lever portion 23 and a cartridge 24. A distal end of the supporting plate 22 is installed on a frame 11, which may be a part of the frame of the sheet processing device 10 and may also be a fixed and stationary portion of the device. The lever portion 23 is pivotally installed at a proximal side of the supporting plate 22. In particular, the lever portion 23 is installed at the proximal end of the supporting plate 22 through a pivot shaft. The cartridge 24 is also installed at a proximal end of the lever portion 23, and the cartridge 24 is provided with a gripper bar abutment and an adjusting means 28 for precisely adjusting the position of the gripper bar.

It can be seen from FIG. 4 that the supporting plate 22 is an integrally formed plate and has an overall curved shape, the distal end thereof is fixedly connected to the frame 11 and the proximal end is toward the paper-feeding side where the lever portion 23 is pivotally installed.

In this embodiment, the gripper bar locking apparatus 20 is further provided with a connecting lever 25 which extends substantially parallel to the supporting plate 22. The distal end of the connecting lever 25 is pivotally connected to a part of a device frame and the proximal end of the connecting lever 25 is pivotally connected to the lever portion 23. Usually, the connecting lever 25 is also attached to an actuating means (not shown) such as a cam mechanism or a cylinder. With the actions of the actuating means, the connecting lever 25 drives the lever portion 23 to pivot. Meanwhile, the connecting lever 25 may also be provided with a stop to correspondingly limit a pivot angle of the lever portion 23.

When the lever portion 23 pivots with the drive of the connecting lever 25, the lever portion 23 pivots about the supporting plate 22 and the connecting lever 25 also pivots about the frame. When the pivoting of the connecting lever 25 about the frame is stopped, the pivoting of the lever portion 23 about the supporting plate 22 is stopped correspondingly.

Figure 5A:
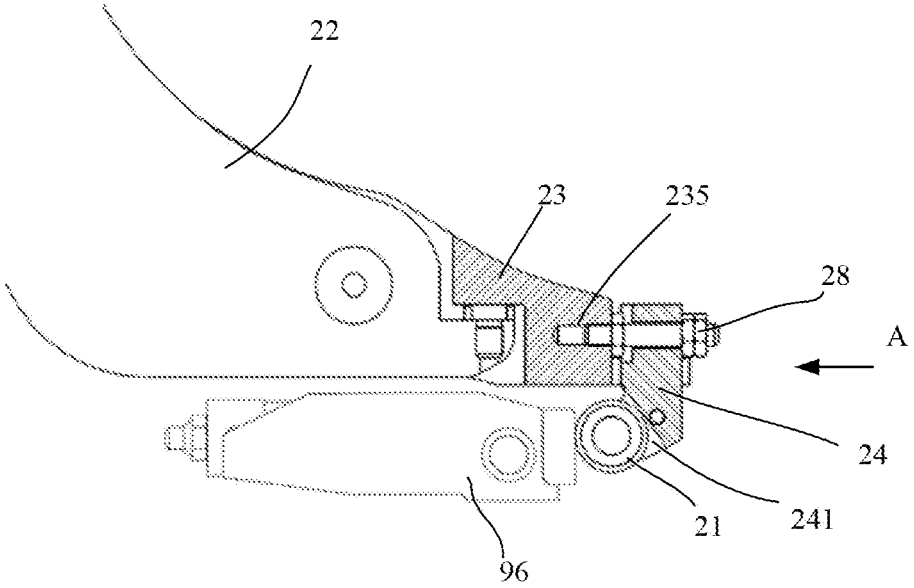
FIG. 5A shows a partial section view of a gripper bar locking apparatus according to a preferred embodiment of the present invention in which a gripper bar locking roller engages with a gripper bar.
Figure 5B:
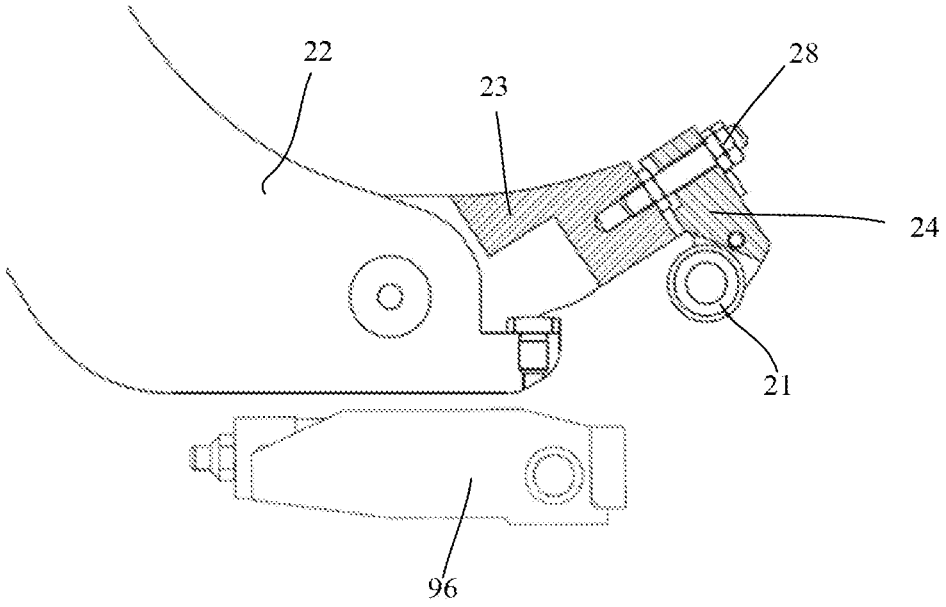
FIG. 5B shows a partial section view of a gripper bar locking apparatus according to a preferred embodiment of the present invention in which a gripper bar locking roller disengages from a gripper bar.

The lever portion 23 may move between the engagement position and the disengagement position under the actuation of the actuating means (not shown). In the engagement position, as shown in FIG. 5A, the lever portion 23 moves a gripper bar abutment to engage with a positioning block 96 of the gripper bar 90 so as to lock the gripper bar 90; in the disengagement position, as shown in FIG. 5B, the lever portion 23 pivots upwards to unlock the gripper bar 90, and the pivot angle of the lever portion 23 is sufficient to ensure that the movement of the gripper bar 90 underneath is not blocked. It can be seen clearly from FIGS. 5A and 5B that the positioning block 96 of the gripper bar 90 is located underneath the lever portion 23.

Back to FIG. 4, in this embodiment, two extensions are provided at the distal end of the lever portion 23. A first extension 231 is connected to the supporting plate 22 through a pivot shaft. A second extension 232 is connected to the connecting lever 25 through another pivot shaft. A recess is provided between the two extensions 231 and 232 and the proximal end of the supporting plate 22 is accommodated in this recess.

A sliding portion 233 is provided at the proximal end of the lever portion 23 toward the paper-feeding side. The cartridge 24 is slidably installed on the sliding portion 233. In this embodiment, the sliding portion 233 is in a form of sliding platform. However, it can be understood that other forms of sliding portions are also feasible, for example, the proximal end of the lever portion forms a sliding slot.

The movement of the cartridge 24 relative to the sliding portion 233 may be locked by a fastening means 27. In this embodiment, the fastening means 27 comprises fastening bolts provided at two opposite sides. When the cartridge 24 is adjusted in place along the sliding portion, the position of the cartridge 24 may be locked by screwing the fastening bolt tight.

The adjusting means 28, such as an adjusting bolt, is installed on the cartridge 24, for finely adjusting the position of the gripper bar 90. It can be seen clearly from FIGS. 5A and 5B that the adjusting bolt passes through a through hole provided on the cartridge 24 and is then connected into a threaded hole 235 provided at one side of the proximal end of the lever portion 23. A nut is also provided on the bolt between the cartridge 24 and the lever portion 23. In the case where the fastening means 27 is released, the cartridge 24 may move along the sliding portion 233 of the lever portion 23 by screwing the adjusting bolt. In the engagement position shown in FIG. 5, the sliding direction of the cartridge 24 is substantially the same as the paper advance direction A.

FIG. 3 shows a bottom perspective view of a gripper bar locking apparatus 20 according to a preferred embodiment of the present invention. It can be seen clearly from FIG. 3 that a gripper bar abutment 21 is supported by the cartridge 24.

In particular, the cartridge 24 forms an abutment supporting portion 241 for supporting the gripper bar abutment 21. The supporting portion 241 is formed with the cartridge 24 and extends to the underneath of the lever portion 23. Preferably, the gripper bar abutment 21 is in a form of roller and rotatably supported on the abutment supporting portion 241 of the cartridge 24. When the lever portion 23 pivots to the engagement position as shown in FIG. 5B, the circumferential surface of the roller is abutted against the positioning block 96 of the gripper bar 90.

The positioning block 96 is provided at an end of the rod of the gripper bar 90 and a proximal side of the positioning block 96 is provided with a flat surface and abutted against the circumferential surface of the roller. The positioning block 96 of the gripper bar 90 is disposed underneath the lever portion 23 and will not contact the bottom surface of the lever portion 23. That is, in the locked position, merely the roller as the abutment 21 on the cartridge 24 contacts the positioning block 96.

Before the sheet processing device 10 starts to process sheets such as paper boards, the gripper bar locking apparatus 20 according to the present invention locks and adjusts the start position of the gripper bar. One of the plurality of gripper bars 90 moves to the paper-feeding side of the platen die cutting station 100 under the drive of the chain along the circulation path. At this moment, the lever portion 23 of the gripper bar locking apparatus 20 pivots upwards and then stays in a disengagement position. When the gripper bar moves in place, the lever portion 23 of the gripper bar locking apparatus 20 pivots downwards to the engagement position under the actuation of the actuating means and the gripper bar abutment 21 directly contacts the positioning block 96 of the gripper bar. Next, an operator adjusts the adjusting means 28 on the cartridge 24 to precisely adjust the gripper bar 90 to a precise position along the paper advance direction.

During the adjustment of the adjusting means 28, the gripper bar abutment is always kept in contact with the positioning block 96 of the gripper bar locking apparatus 20 by means of a spring return means provided at the back side of the positioning block 96.

Usually, in the sheet processing device 10, two gripper bar locking apparatuses 20 are disposed at two sides of the gripper bar rod 91. The gripper bar locking apparatus 20 at one side is connected to the actuating means and is constructed as an active-side gripper bar locking apparatus 20. The gripper bar locking apparatus 20 at the other side is a passive-side gripper bar locking apparatus 20 which is connected to the active-side gripper bar locking apparatus 20 through a lateral connecting lever and moves correspondingly. Correspondingly, the positioning block 96 is provided at either side of the gripper bar 90. In a locked state, the active-side and passive-side gripper bar locking apparatuses 20 both contact the positioning block 96.

As shown in FIG. 4, the gripper bar locking apparatus 20 is disposed at the inner side of the chain wheel 92. i.e., at one side of the gripper bar rod 91, and the wheel drives the gripper bar conveyor apparatus. The supporting plate 22 of the gripper bar locking apparatus 20 and the distal end of the connecting lever 25 will be shielded by other components of the sheet processing device as shown by the dashed lines, while the positions of the cartridge 24 and the adjusting means 28 are toward the paper-feeding direction and can be accessed by an operator easily, and thus it is convenient to adjust the gripper bar along the paper advance direction.

In addition, the supporting plate 22 is a fixed and stationary component and thus the overall rigidity of the gripper bar locking apparatus 20 is improved. In the meantime, the lever portion 23 is connected to the supporting plate 22 through the first extension 231 and connected to the connecting lever 25 through the second extension 232. Thus, the lever portion 23 is connected across the supporting plate 22 and the connecting lever 25 so that the rigidity of the lever portion 23 per se is ensured and the locking precision of the gripper bar locking apparatus 20 is improved correspondingly.

There may be other variations in the gripper bar locking apparatus 20. For example, the sliding portion 233 on the lever portion 23 may be formed as a sliding slot and the adjusting means 28 may adopt a translation adjusting mechanism such as rack and so on.

In addition, the gripper bar abutment 21 may also be in other forms, for example, being a sliding surface integrally formed on the abutment supporting portion 241 of the cartridge 24.

The sheet processing apparatus suitable for the gripper bar locking apparatus 20 according to the present invention may be a hot foil stamping device and the gripper bar locking apparatus 20 is installed at the paper-feeding side of the platen die cutting station 100 in this device. However, it can be understood that the gripper bar locking apparatus 20 according to the present invention may also be applied to other sheet processing devices including a gripper bar mechanism and any stations where it requires to adjust the position of the gripper bar may dispose the gripper bar locking apparatus 20 according to the present invention as required.

Although the present invention is disclosed as above with preferred embodiments, the present invention is not limited thereto and a person skilled in the art may make possible variations and modifications without departing from the spirit and scope of the present invention. Thus, any modifications, equivalent changes and variations made to the above embodiments according to the technical essence of the present invention without departing from the disclosure of the technical solution of the present invention all fall into the protection scope defined by the claims of the present invention.

The invention claimed is:

1. A gripper bar locking apparatus, which is configured to lock and adjust a position of a gripper bar, comprising:

a supporting plate having a distal end and a proximal end;

a lever portion, a distal end of which is pivotally mounted on the proximal end of the supporting plate;

a cartridge movably mounted on a proximal end of the lever portion and provided with a gripper bar abutment; and an adjusting means provided on the cartridge and configured to adjust a position of the cartridge with respect to the lever portion.

2. The gripper bar locking apparatus of claim 1, wherein the lever portion comprises a sliding portion, and the cartridge slides on the sliding portion, and the cartridge is further provided with a fastening means for locking the cartridge with respect to the sliding portion of the lever portion.

3. The gripper bar locking apparatus of claim 1, wherein the gripper bar abutment is a roller pivotally mounted on the cartridge, and the roller is located below a bottom of the lever portion.

4. The gripper bar locking apparatus of claim 1, wherein the adjusting means is an adjusting bolt extending through a hole provided in the cartridge into a threaded hole provided at a side surface at the proximal end of the supporting plate.

5. The gripper bar locking apparatus of claim 1, wherein the lever portion is configured to move between an engagement position, where the gripper bar abutment engages with the gripper bar, and a disengagement position, where the gripper bar abutment disengages from the gripper bar to release the locking.

6. The gripper bar locking apparatus of claim 5, wherein the gripper bar further comprises a connecting lever, a proximal end of the connecting lever is pivotally connected to the lever portion, and the connecting lever is configured to move the lever portion between the engagement position and the disengagement position.

7. The gripper bar locking apparatus of claim 6, wherein the lever portion includes a first extension and a second extension, the first extension is pivotally connected to the supporting plate, the second extension is pivotally connected to the connecting lever, and a recess is formed between the first extension and the second extension, the proximal end of the supporting plate is received in the recess.

8. A sheet processing device, comprising:

a plurality of sheet processing stations;

a conveyor including a plurality of gripper bars for gripping a sheet, which is moved to the plurality of stations with a movement of conveyor; and the gripper bar locking apparatus, as claimed in claim 1, positioned on at least one of the plurality of sheet processing stations so as to lock one of the gripper bars at the at least one station, and the supporting plate of the gripper bar locking apparatus is fixed to a frame of the sheet processing device.

9. The sheet processing device of claim 8, wherein the plurality of sheet processing stations comprises a platen die cutting station, and the gripper bar locking apparatus is mounted at a sheet-feeding side of the platen die cutting station.

10. The sheet processing device of claim 8, wherein an end of the gripper bar is provided with a locating block, which is arranged to abut against the gripper bar abutment.

* * * * *